US008466609B2

(12) United States Patent
Rintamaki et al.

(10) Patent No.: US 8,466,609 B2
(45) Date of Patent: Jun. 18, 2013

(54) METHOD AND APPARATUS FOR POSITIONING A CERAMIC INDUCTION DISCHARGE BODY RELATIVE TO AN INDUCTION COIL

(75) Inventors: Joshua Ian Rintamaki, Westlake, OH (US); Andrew Lawrence Podevels, University Heights, OH (US); Jianwu Li, Solon, OH (US); Paul M. Kuester, Shaker Heights, OH (US); Viktor Karoly Varga, Solon, OH (US); Glenn Howard Kuenzler, Beachwood, OH (US)

(73) Assignee: General Electric Company, Schenectady, NY (US)

( * ) Notice: Subject to any disclaimer, the term of this patent is extended or adjusted under 35 U.S.C. 154(b) by 297 days.

(21) Appl. No.: 12/609,034

(22) Filed: Oct. 30, 2009

(65) Prior Publication Data

US 2010/0109503 A1 May 6, 2010

Related U.S. Application Data

(60) Provisional application No. 61/110,398, filed on Oct. 31, 2008.

(51) Int. Cl.
*H01J 1/00* (2006.01)

(52) U.S. Cl.
USPC ..... 313/238; 313/161; 315/248; 445/26

(58) Field of Classification Search
USPC ..... 313/483–493, 623, 627–643, 567, 313/111–117, 25–27, 317, 318.01–318.09, 313/153–162; 439/615, 739; 445/24, 26, 445/29, 22
See application file for complete search history.

(56) References Cited

U.S. PATENT DOCUMENTS

| | | | | | |
|---|---|---|---|---|---|
| 3,444,460 | A | * | 5/1969 | Penney, Jr. | 324/260 |
| 5,438,235 | A | * | 8/1995 | Sommerer et al. | 313/489 |
| 5,440,199 | A | * | 8/1995 | Heindl et al. | 313/318.07 |
| 5,637,963 | A | * | 6/1997 | Inoue et al. | 315/248 |
| 5,754,000 | A | * | 5/1998 | Skilton et al. | 313/565 |
| 5,998,914 | A | * | 12/1999 | Kohne et al. | 313/161 |

FOREIGN PATENT DOCUMENTS

| | | | |
|---|---|---|---|
| JP | 08055612 | * | 2/1996 |
| JP | 08148125 A | * | 6/1996 |

* cited by examiner

*Primary Examiner* — Donald Raleigh
(74) *Attorney, Agent, or Firm* — Fay Sharpe LLP

(57) ABSTRACT

An electrodeless or induction ceramic HID lamp includes a ceramic arc body having a generally spheroidal portion enclosing a discharge chamber and an induction coil received around a perimeter portion of the spheroidal portion. At least one leg extends from the spheroidal portion of the arc body. A mounting structure connects the arc body to the surrounding lamp assembly. In one arrangement, a mounting tube is received over at least a portion of the leg, and may further include a light transmissive shroud that also abuts with the induction coil to precisely locate the arc body relative to the coil. In another arrangement, first and second mounting members extend from spaced locations of the arc body, either as pins or legs extending from the spheroidal portion, or radially extending legs from an equatorial portion of the arc body. In still another arrangement, a ceramic mounting member extends from the arc body and includes a thin peripheral rim having spaced ridges to engage spaced locations of the induction coil.

8 Claims, 6 Drawing Sheets

METHOD AND APPARATUS FOR POSITIONING A CERAMIC INDUCTION DISCHARGE BODY RELATIVE TO AN INDUCTION COIL

This application claims the priority benefit is U.S. provisional application Ser. No. 61/110,398, filed 31 Oct. 2008, the entire disclosure of which is hereby expressly incorporated herein by reference.

BACKGROUND OF THE DISCLOSURE

The present disclosure relates generally to electrodeless high intensity discharge (HID) lamps. More particularly, this disclosure relates to a ceramic induction HID system and different methods and apparatus for positioning and holding a ceramic discharge chamber inside an induction coil.

HID lighting was initially developed in the 1960's and such lighting provides approximately twenty percent (20%) of all artificial light. The electrodeless HID lamps provide a unique combination of high efficacy, high brightness, high wattage, long life, and good color. Presently, induction HID systems rely on a positioning member to hold a discharge vessel or arc body at a prescribed location relative to and within an annular induction coil. Such a construction is highly susceptible to mechanical motion which adversely results in a change in the coupling between the coil and the arc body, mostly compromising coupling efficiency and consequently decreasing efficacy of the system. Further, known positioning members are typically connected to the coil in a manner that blocks a significant amount of usable light.

Whereas quartz arc bodies have been used in the past, a ceramic arc body presents different challenges. Improved resistance to dose loss, and the ability to operate at higher temperatures in an efficient manner are just a few reasons to use a ceramic material for the arc body. Particularly, the ceramic arc body can operate at higher temperatures but is also prone to cracking if it experiences a large thermal gradient such as by contact with a material with a substantially different temperature. It is important that the ceramic arc body not be permitted to engage the coil because the differences in temperature of the two materials will lead to cracking of the ceramic. Optimal operation of the electrodeless ceramic HID lamp also requires precise location between the arc body and the surrounding coil. Thus, there are competing concerns of accurately and precisely locating the arc body within the coil, addressing thermal issues, and maximizing the amount of light output from the assembly, i.e., not unduly blocking large portions of the light output.

However, alternative ways to precisely locate the ceramic arc body within the induction coil, and for limiting the potential for high temperature gradients as a result of using materials having different thermal coefficients, which leads to cracking and leakage of the dose, are required.

SUMMARY OF THE DISCLOSURE

An electrodeless HID lamp includes a ceramic arc body having a generally spheroidal portion enclosing a discharge chamber. An induction coil is received around a perimeter portion of the spheroidal portion. A leg extends from the spheroidal portion of the arc body and includes a (non-conductive) mounting tube connected thereto for supporting the arc body.

A light transmissive (non-conductive) shroud is preferably connected to the mounting tube and covers at least a portion of the arc body.

A first end of the shroud is connected to the mounting tube and a second end of the shroud abuts the induction coil for precisely locating the arc body relative to the induction coil.

An alternative arrangement of an electrodeless HID lamp includes an arc body having a discharge chamber with an induction coil received around a perimeter portion of the arc body. First and second mounting members extend from spaced locations of the arc body.

The first and second mounting members extend from the arc body and connect to the conduction coil.

The first and second members in one arrangement are disposed in substantially the same plane as the coil.

In another arrangement, the first and second members include mica disks that abut a peripheral surface of the arc body and are disposed substantially parallel to the induction coil.

In yet another arrangement, the first and second members are ceramic members that extend at an included angle therebetween of less than 180°.

A further arrangement of an electrodeless HID lamp includes a ceramic arc body having a discharge chamber with an induction coil received around a perimeter portion of the arc body. A ceramic mounting member extends from the arc body and includes a thin peripheral rim having circumferentially spaced ridges for engaging circumferentially spaced locations of the induction coil.

The ceramic mounting leg includes an opening therethrough for serving as a dosing port.

The arc body may also include first and second hemispherical portions having different conformations.

A primary advantage of this disclosure is the ability to accurately locate the arc body relative to the induction coil.

Another advantage resides in the ability to preclude drastic thermal gradients that would otherwise lead to cracking of the ceramic arc body.

Another advantage resides in the ease with which the mounting structure may be formed.

Yet another benefit resides in the precise location between the arc body and induction coil to provide optimal coupling efficiency and simultaneously limit the amount of light blockage.

Still other benefits and advantages will become more apparent from reading and understanding the following detailed description.

DETAILED DESCRIPTION OF THE PREFERRED EMBODIMENTS

Figure 1:
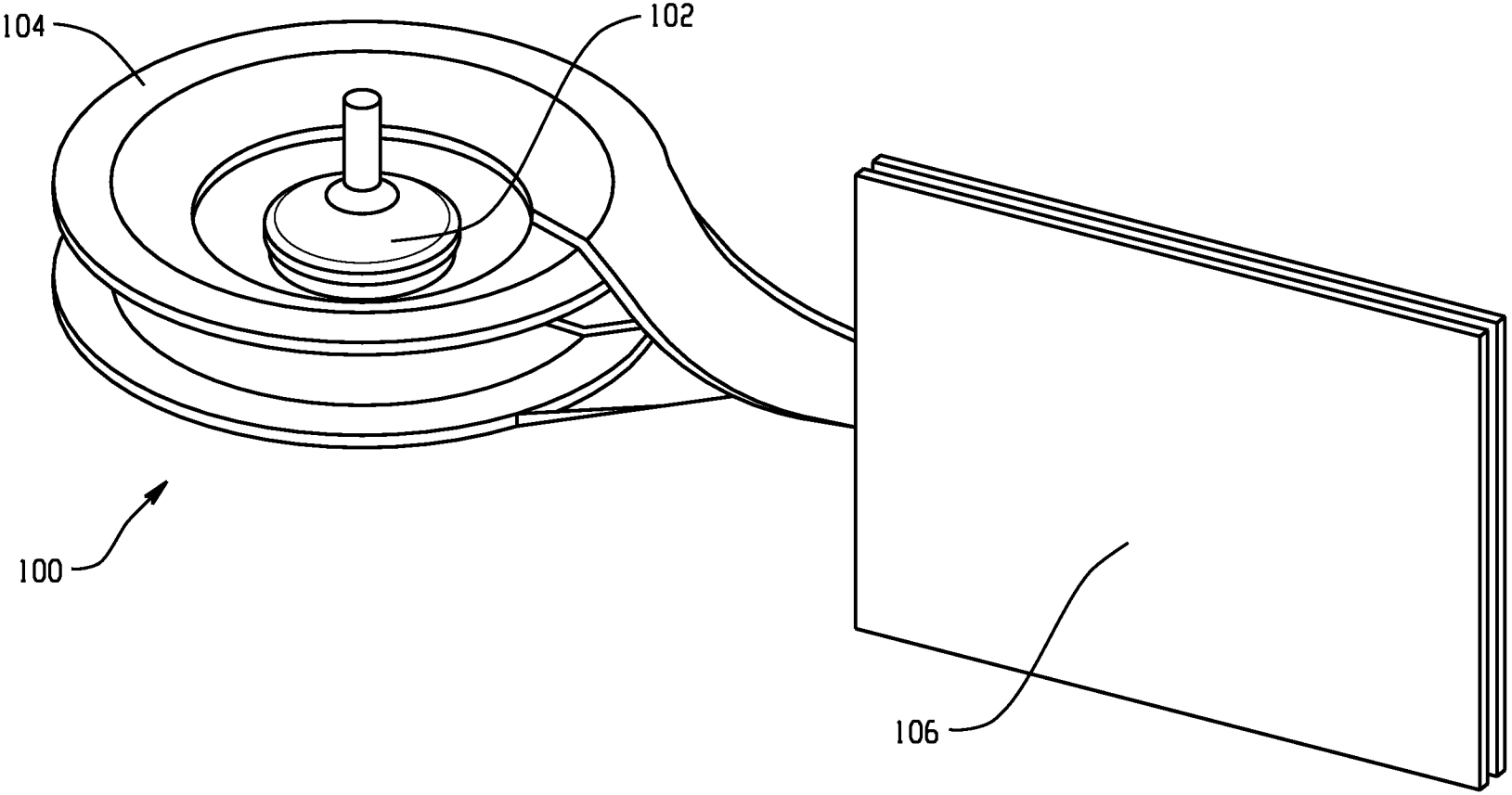
FIG. 1 is a representative example of an induction ceramic high intensity discharge lamp system.

FIG. 1 generally illustrates an electrodeless or induction high intensity discharge (HID) lamp assembly 100 that includes an arc body 102 precisely located within a central opening of a radio frequency (RF) coil 104. The coil is shown as a multi-turn coil and mechanically and electrically connected to capacitive plates 106 so that power and energy from the drive circuit or ballast (not shown) provides the desired inductive and capacitive operation of the lamp assembly. More particular details of the overall assembly and operation of the lamp system may be obtained from co-pending applications U.S. Ser.No. 12/609,048, filed Oct. 30,2009 (now abandoned) and U.S. Ser. No. 12/263,222, filed Oct. 21,2008 (now abandoned), as well as U.S. Pat. Nos. 5,039,903 and 5,214,357.

It has been determined that an HID lamp where the arc body 102 is formed of a ceramic has the potential for substantial improvement over the prior quartz arrangement. A ceramic HID lamp is believed capable of a lamp life on the order of approximately fifty thousand (50,000) hours. Precise positioning of the arc body within the surrounding coil is important to achieving this lamp life. With continued reference to FIG. 1, and additional reference to FIGS. 2 and 3, a first preferred mounting arrangement of the present disclosure will be described in greater detail. The arc body includes a generally spheroidal portion 120 that in cross-section has the general shape of an ellipse with an elongated axis in one direction and a shorter axis in a perpendicular direction. A single ceramic leg or arc body extension 122 extends generally perpendicularly outward from a first or polar region 124 of the spheroidal portion. The Figures are representative of the concept and, in actual practice, there likely will be smoother transitions between the leg and the spheroidal portion, i.e., the walls will merge more smoothly one into the other. The leg is closed at its terminal end spaced form the spheroidal portion and encloses a hollow cavity that communicates with an internal discharge chamber in the spheroidal portion.

At least partially surrounding the ceramic leg is a quartz member, preferably a hollow member or tube 130. Of course, it will be appreciated that other high-temperature glasses, such as borosilicate and alumino-silicate could also be used instead of quartz so that the reference to the quartz tube is for exemplary reasons only. The quartz tube is concentrically received over the leg, and cement secures the tube to the ceramic leg. In a preferred arrangement, the tube nominally extends approximately 2-3 mm, but could be along the entire extent of the ceramic leg until the curvature of the arctube interferes with the fit. The extent of coverage of the hollow tube over the leg should be long enough to provide structural stability but not so long as to adversely affect the thermals of the arc body. The cement is preferably a material that has a thermal coefficient that is intermediate the ceramic and the quartz so that there is less prospect of the ceramic leg cracking due to a high thermal gradient. The quartz tube can be held in various ways in the remainder of the lamp assembly. For example, a metal clamp may be positioned at a location spaced from the RF field of the coil. By way of example only, if the length of the ceramic leg is approximately 10 mm, then the quartz tube may be connected to approximately 2-3 mm of outer end of the leg length.

Figure 2:
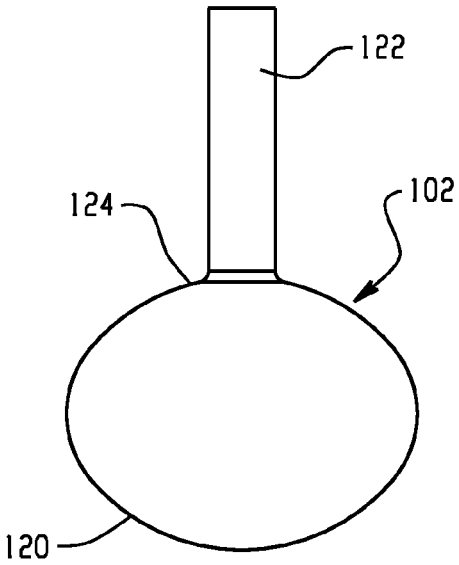
FIG. 2 is an elevational representation of an arc tube with a single ceramic leg extending therefrom.
Figure 3:
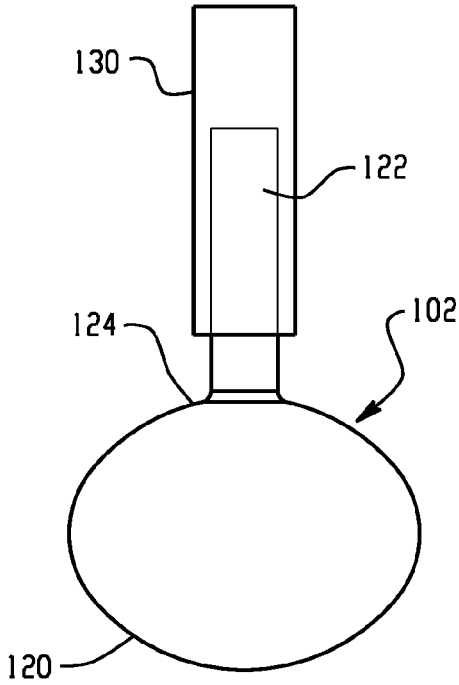
FIG. 3 shows the arc body of FIG. 2 with an additional quartz tube received at least partially over the leg.
Figure 4:
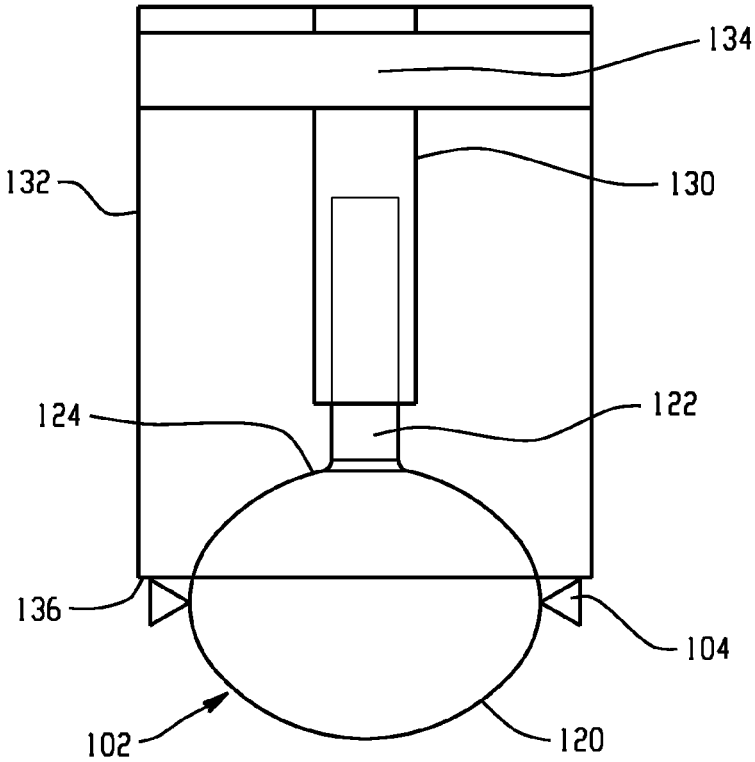
FIG. 4 shows the arc body and quartz tube arrangement of FIG. 3 with the addition of a light transmissive cylinder thereover.

FIG. 4 is a further embodiment that adds to the concept of FIGS. 2 and 3 by subsequently incorporating the arc body and joined quartz tube within a larger quartz component, preferably a substantially cylindrical component 132. For ease of reference, this component 132 will be generally referred to as a quartz cylinder, although alternative materials such as borosilicate and alumino-silicate, and likewise alternative configurations, may be used without departing from the present disclosure. One effective preferred manner of securing the quartz tube 130 within the cylinder 132 is to pinch the tube within the cylinder at an end spaced from the spheroidal portion. The pinch region is generally identified by reference numeral 134. As will be appreciated from FIG. 4, the pinch region is located in spaced location from the ceramic arc body and adjacent a first end of the quartz tube and quartz cylinder. One preferred manner of creating the pinch is by applying a hydrogen/oxygen flame on a rotating bench as is commonly used to pinch quartz arctubes. A second end 136 of the cylinder abuts with the induction coil 104 and serves as a further mounting of the quartz tube and cylinder to the arc body and further concentrically locates the arc body relative to the coil. Thus, the tube 130 is cemented to the leg 122 at one end and secured to the cylinder 132 via the pinch region, and the cylinder abuts against the coil 104 at the opposite end to concentrically locate the arc body relative to the coil. Although other materials or configurations can be used, the mounting arrangements of FIGS. 3 and 4 are relatively simple and easy to assemble.

Figure 5:
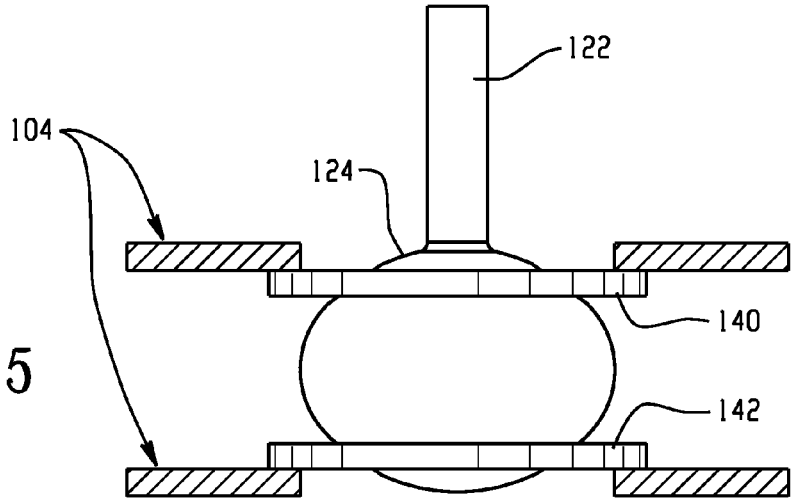
FIG. 5 shows the arc body of FIG. 2 with the inclusion of mica disks.

Still another manner of mounting the single leg ceramic arc body envelope of FIG. 2 into a surrounding lamp structure uses first and second disks or annular rings that rest on the top of the ceramic spheroidal portion 120 of the arc body and below the equatorial portion of the spheroidal portion (FIG. 5). Mica is a preferred disk material since it is electrically non-conductive and can withstand elevated temperatures in order to hold the ceramic arc body while the lamp is operational. Moreover, the annular ring arrangement provides for a limited region of contact of the disks with the arc body and provides another way to hold the arc body without securing to the leg. The induction coil 104 is then received on the top and bottom of the mica disks to sandwich the disks between the coil turns. Mica is not perfectly clear and has some variability since it is a natural material. Therefore, the mica rings are not ideal for all optical uses because there will be some variability. However, mica has sufficient laminar strength when compared, for example, to a similarly formed quartz disk that would tend to be very fragile.

Figure 6:
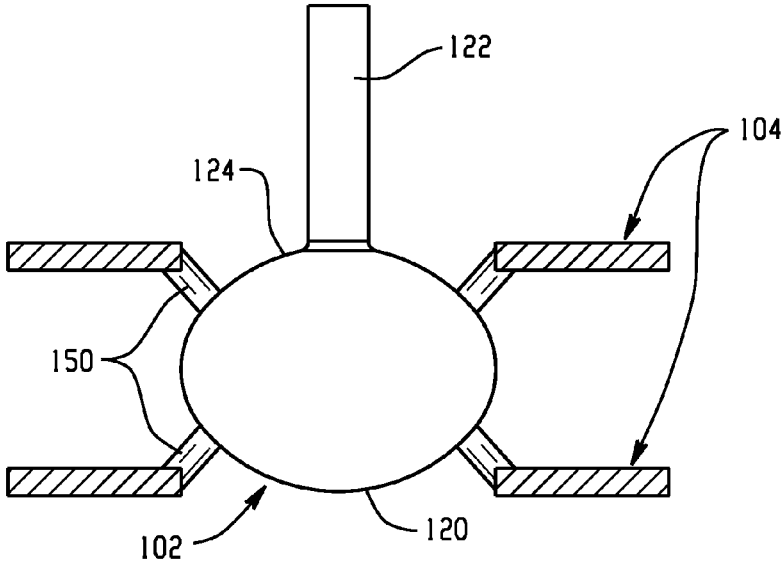
FIG. 6 illustrates the arc body of FIG. 2 with the addition of ceramic feet for location purposes.

Still another preferred embodiment (FIG. 6) of mounting the arc body in the lamp assembly uses a series of pins or legs 150 that extend outwardly from the spheroidal portion of the arc body. The legs 150 may be similarly or dissimilarly shaped, and are preferably joined to the arc body through the green joining process shown and described in commonly-assigned co-pending application Ser. No. 11/942,857, filed Nov. 20, 2007, the disclosure of which is expressly incorporated herein by reference. The legs preferably extend from the spheroidal portion of the arc body and into engagement with similarly dimensioned locating holes or recesses in the surrounding induction coil. This provides for a unique mounting arrangement that does not block significant amounts of light from the lamp assembly, and provides further precision in accurately locating or positioning the arc body relative to the induction coil. Moreover, there are only small areas of contact with the coil but with a high degree of accuracy in locating the arc body relative to the coil. It will be apparent from the drawing that the pins 150 extending from the arc body are preferably spaced apart by an included angle of less than 180 degrees between the pins to provide stability to the mounting arrangement.

Figure 7:
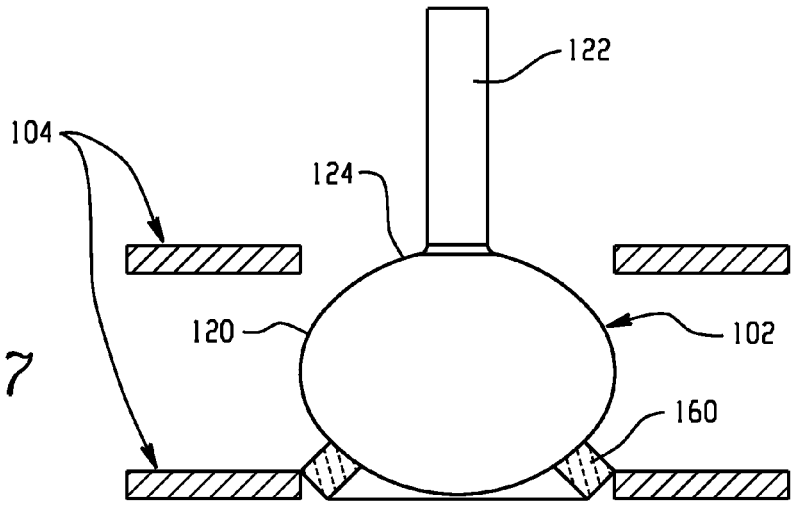
FIG. 7 shows the arc body of FIG. 2 with the inclusion of an annular quartz support member.

As noted above with respect to the embodiment of FIG. 5, a thin quartz disk is a relatively fragile structure. However, a quartz ring that is generally cone-shaped 160 such as illustrated in FIG. 7 could still be used to locate the arc body relative to the coil. Again, limited regions of contact would be established between the quartz cone 160 and the arc body 102 as well between the cone and the surrounding coil 104. Again, a limited contact area is desired with the arc body so that heat energy is not drawn from the arc body, i.e., the coil does not serve as a heat sink relative to the ceramic arc body.

Figure 8:
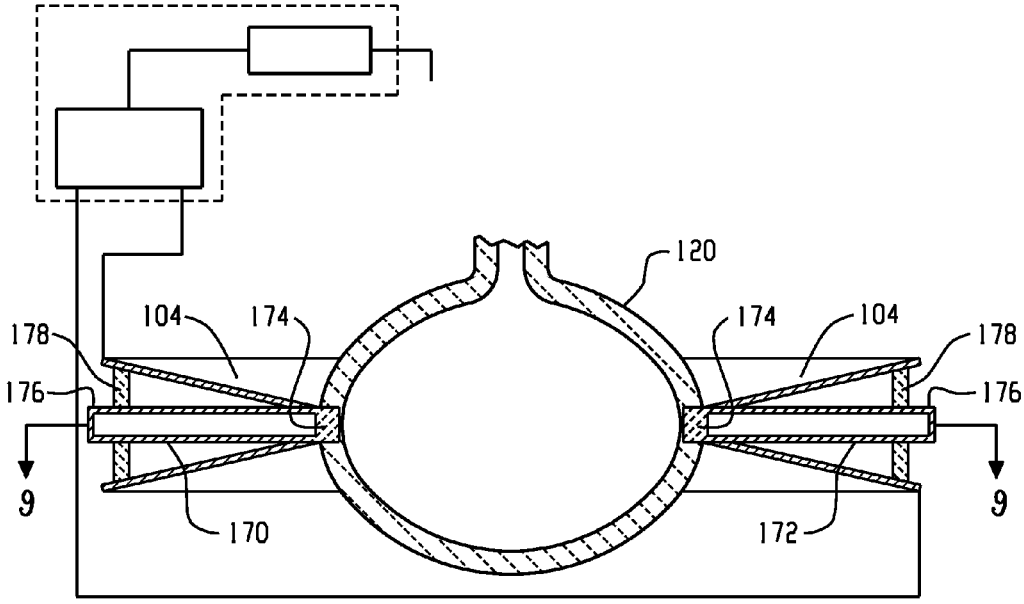
FIG. 8 is an elevational cross-sectional view of a spheroidal arc body incorporating first and second mounting members.
Figure 9:
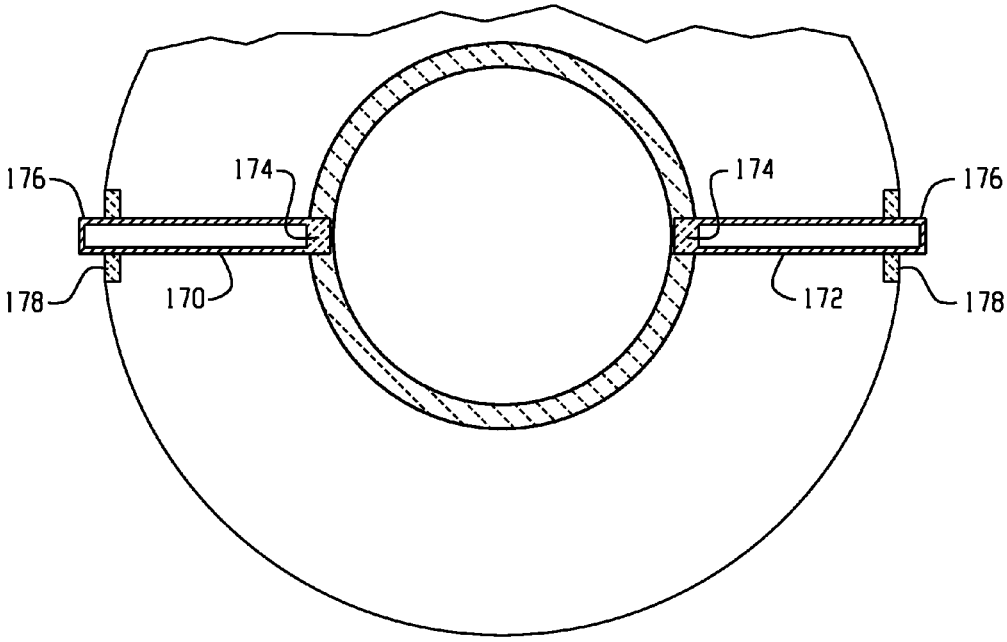
FIG. 9 is a view taken generally along the lines 9-9 of FIG. 8.

The preferred embodiment of FIGS. 8 and 9 illustrates use of first and second members, namely radially extending legs 170, 172, to join the arc body to the induction coil. Again, the green joining techniques described in the commonly-owned co-pending application referenced above may be used to join the first and second legs to the arc body, preferably from equatorial regions thereof, and disposed in diametrically opposite directions as illustrated in FIGS. 8 and 9 and in the same general plane as the multi-turn coil 104. Radial inner ends 174 of the legs transition with the spheroidal portion 120 of the lamp assembly. The second or outer radial ends 176 of each ceramic leg pass through a locating disk, preferably an annular disk or plug 178 that is dimensioned for receipt between respective first and second portions of the RF coil 104. Preferably this disk 178 is formed of an electrically non-conductive material, for example, mica, quartz, or ceramic, or another material that is similarly non-conductive and has a thermal coefficient that is between the metal of the coil and the ceramic leg. Use of the equatorial legs is desirable since one leg can be used for dosing purposes and since the location of the legs within the general plane of the coil does not adversely impact on light output from the arc body. Since the induction coil desirably does not contact the arc body, recesses are provided in the coil and the mounting legs only make contact or mount along the outer diameter regions where the thermals are substantially less in comparison to the inner diameter regions of the legs. In some designs, it may be desirable to use light from both the north and south polar regions so that elimination of the leg from the polar regions is desirable and the equatorial leg arrangement of FIGS. 8 and 9 can be advantageously used.

This FIGS. 8-9 embodiment provides a simple means of positioning and holding a ceramic discharge body inside an induction coil for a ceramic induction HID system. The structural integrity of the coil and arc body assembly are enhanced, and there is improved positioning of the arc body relative to the coil without blocking supporting members that are required in prior art arrangements. By moving the positioning means into the plane of the induction coil, overall positioning capability between the arc body and the induction coil is improved, and at the same time light blocking is minimized. In addition to improved arc body-to-coil positioning, there is improved vibrational resistance of the structure. Additional gain may be obtained by allowing the visible radiation from the arc body to be used in both the polar regions and may further enhance the overall system optical design.

Figure 10:
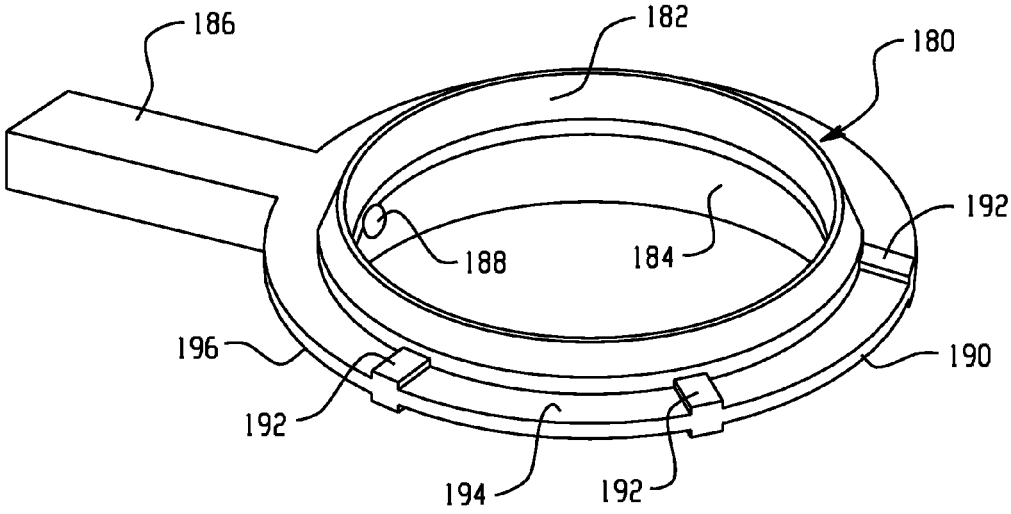
FIG. 10 is a perspective view of an external ceramic locating flange.
Figure 11:
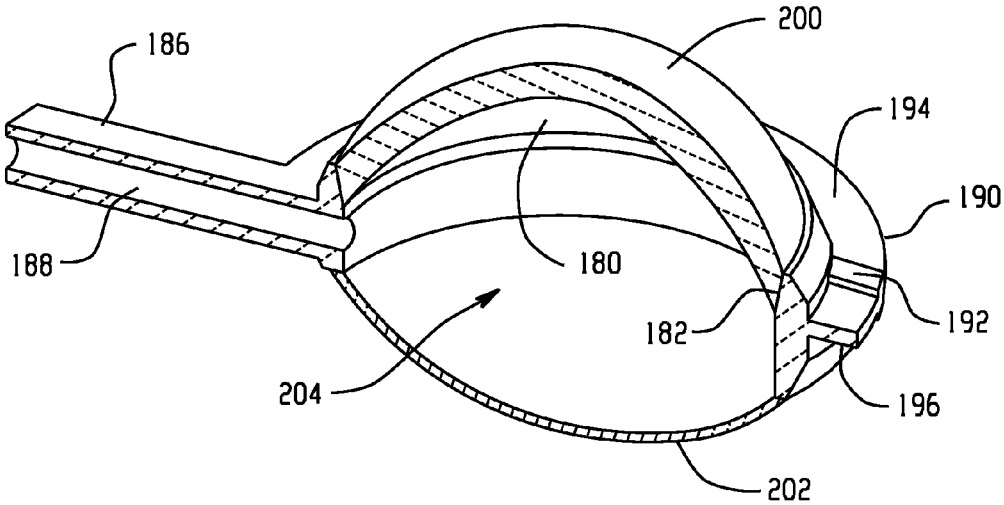
FIG. 11 is a perspective view partially in section of the ceramic arc body with the external locating flange of FIG. 10.

The ability to assemble complex ceramic shapes into an integrated component where the joints are indistinguishable from the remainder of the component allows for an embodiment such as shown in FIGS. 10 and 11 to be used in the electrodeless ceramic HID arrangement. More particularly, three injection-molded ceramic components 180, 200, 202 are joined into an annular shape with an integrated dosing leg as shown in FIG. 11. A first sub-component or ring 180 has a magnifying glass-shape that includes tapered surfaces 182, 184 along an inner diameter opening. A dosing leg 186 extends generally radially outward from the first ring 180 and has an opening 188 extending therethrough for purposes of dosing. As will be appreciated, the dosing leg must pass through the RF coil (not shown for ease of illustration), but does not adversely block additional light output from the arc body. In addition, a thin, locating flange 190 extends around the remaining perimeter of the ring 180. The locating flange 190 preferably has circumferentially spaced bumps or ridges 192 extending from one or both of upper and lower surfaces 194, 196 of the flange. The ridges 192 are intended for abutting engagement and precision location of the ceramic body relative to the RF coil (not shown). Use of the locating flange allows precise positioning relative to the induction coil and eliminates the need for separate mounting hardware.

As more particularly shown in FIG. 11, the remainder of the arc body is provided by a first or upper generally hemispherical cap 200 and a second or lower generally hemispherical cap 202. Preferably, peripheral edges of each cap are dimensioned for engagement with the respective tapered surfaces 182, 184 of the ring 180 and integrally joined, for example, through use of the green joining techniques described in the co-pending application. As is also evident in FIG. 11, each cap may have a slightly different conformation. For example, one cap (e.g., cap 200) may have a more rounded conformation for purposes of reflecting light therefrom and exiting the other cap (e.g., cap 202). Likewise, the second cap 202 may have a more slightly planar shape that allows the second cap to serve as a lens configuration for directing light outward in a desired manner. Further, the dosing opening 188 communicates with the interior cavity 204 of the arc body and thereby allows introduction of the fill. The light transmissive nature of the ceramic, and the ability to precisely locate the arc body relative to the surrounding coil provides for great flexibility in the final design.

It will also be appreciated that the induction ceramic HID lamp of the embodiment of FIGS. 10 and 11 also allows the arc body to be held and positioned accurately with respect to the RF coil. Because lamp efficiency is strongly impacted by the relative positioning of the components, this becomes an important feature. A molded ring component 180 forms the central equatorial portion of the spheroidal shape and allows the separately molded caps to be added as north and south hemispheres to complete the enclosure. In this way, multiple cap designs can be combined, including different north and south caps, to allow greater design flexibility. Locating the dosing port to the side, rather than the top or bottom, results in the mounting structure extending through the plane of the RF coil. This reduces the potential that the mounting structure will block light emanating from the arc body and thus increases overall lumen output.

Figure 13:
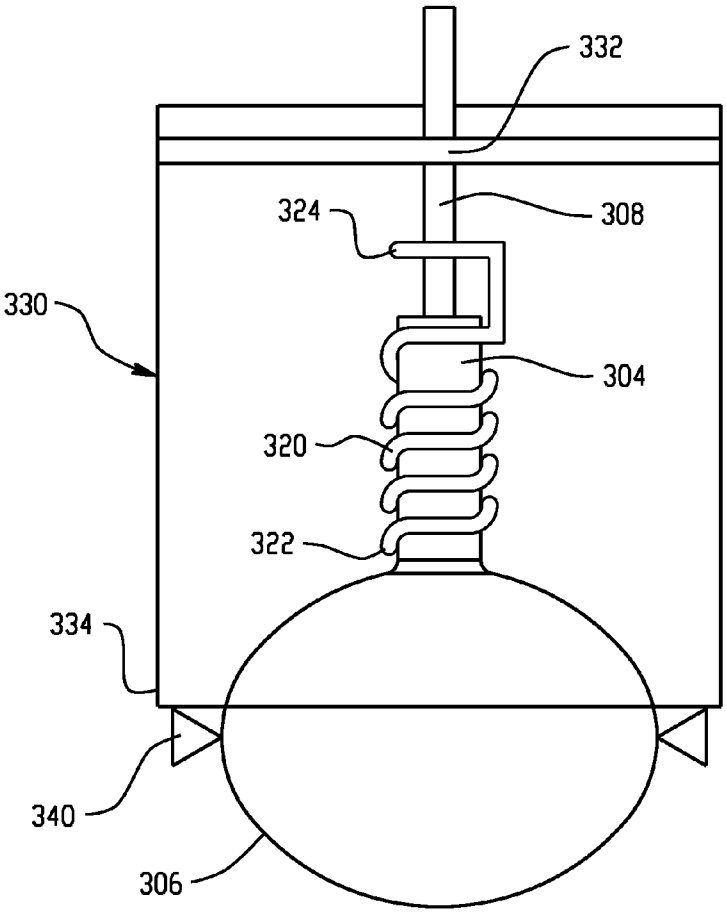
FIG. 13 is an elevational view of the embodiment of FIG. 12 showing additional components of the support assembly.
Figure 12:
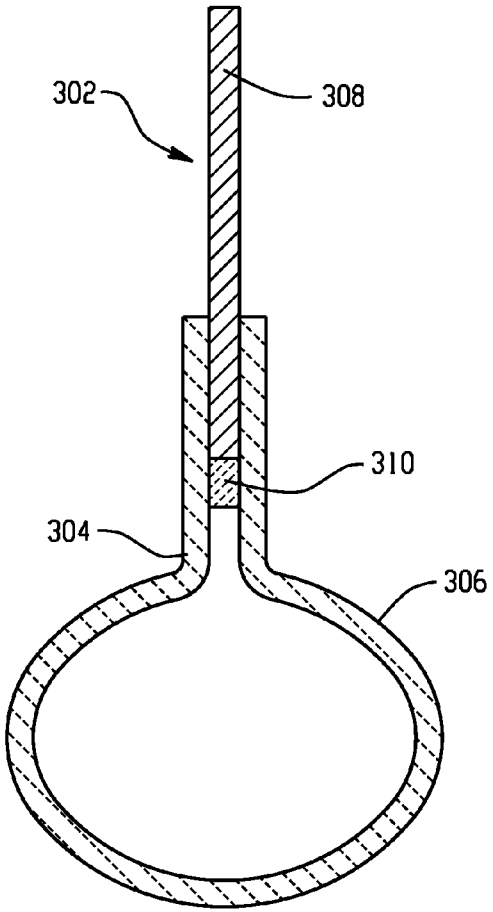
FIG. 12 is an elevational view partially in section illustrating portions of a hybrid electrode to provide support for the arc body and electrical connection for starting purposes.

Another preferred arrangement of a support assembly 300 is shown in FIGS. 12 and 13. More particularly, a hybrid electrode 302 is received in the leg 304 extending from arc body 306 (FIG. 12). The electrode includes a conductive or metal first portion 308 for example along an upper portion and a non-conductive or ceramic second portion 310 along a lower portion that is disposed closer to the main chamber of the arc body 306. The metal and ceramic portions are secured together, by way of example, using an adhesive to bond the components together and form what is termed herein as a hybrid electrode. The hybrid electrode is then secured and sealed in the leg, preferably using a seal glass to fill the space between the outer diameter of the electrode and the inner diameter of the leg. This also advantageously seals the cavity in the leg from the outside environment.

As illustrated in FIG. 13, a starting coil 320 is helically wrapped around (or received in a groove or encased in a material) along the length of the leg 304 extending from a first end 322 adjacent the main chamber of the arc body 306 and terminates at a second end 324 where the second end is mechanically and electrically secured (e.g., welded) to the electrode, particularly, the metal first portion 308. When power is supplied to the starting coil, the fill in the leg is brought to a discharge state and subsequently, RF energy provided through coil 326 surrounding the main arc body chamber will continue to power the inductive or electrodeless lamp as is known in the art. The mounting components shown and described relative to the embodiment of FIG. 4 are used here in the same manner to support and align the arc body within the surrounding coil. That is, the upper end of the hybrid electrode is secured or pinched at 332 within an enclosing support member or quartz cylinder 330 that abuts at an opposite or lower end 334 with the main coil 340.

The disclosure has been described with reference to the preferred embodiments. Obviously, modifications and alterations will occur to others upon reading and understanding the preceding detailed description. It is intended that the disclosure be construed as including all such modifications and alterations.

What is claimed is:

1. An electrodeless high intensity discharge (HID) lamp comprising:

a ceramic arc body having a generally spheroidal portion enclosing a discharge chamber therein;

an induction coil surrounding a perimeter portion of the arc body spheroidal portion;

a positioning structure comprised of non-conductive materials that can withstand high temperature and RF fields that mounts directly to the induction coil and locates the spheroidal arc body both concentrically within an inner perimeter of the induction coil and vertically within top and bottom sections of the induction coil; and a light-transmissive shroud connected to the positioning structure and covering at least a portion of the arc body.

2. The electrodeless HID lamp of claim 1 wherein the shroud is substantially cylindrically shaped and is connected to the positioning structure.

3. The electrodeless HID lamp of claim 1 wherein a first end of the shroud is connected to the positioning structure and a second end of the shroud abuts the induction coil for precisely locating the arc body relative to the induction coil.

4. The electrodeless HID lamp of claim 3 further comprising a hybrid rod received in a leg extending from the spheroidal portion of the arc body and having a starting coil connected thereto that helically surrounds the leg.

5. An electrodeless HID lamp comprising:

a ceramic arc body having a discharge chamber therein;

an induction coil surrounding a perimeter portion of the arc body; and a ceramic mounting member extending from contact with the arc body and including a thin peripheral rim having circumferentially spaced ridges for engaging circumferentially spaced locations of the induction coil wherein the ceramic mounting member includes an opening therethrough for serving as a dosing port.

6. The electrodeless HID lamp of claim 5 wherein the induction coil includes minimal dimensioned recesses at the spaced locations for receiving the ridges therein.

7. The electrodeless HID lamp of claim 5 wherein the arc body includes first and second hemispherical portions having different conformations.

8. A method of supporting an electrodeless ceramic metal halide (CMH) lamp comprising:

providing an arc body having a substantially spheroidal portion having a discharge chamber therein and a leg extending from the spheroidal portion;

locating an induction coil around a perimeter of the spheroidal portion of the arc body;

mounting the leg to a surrounding tube member to support the arc body;

joining a first end of the tube member to the leg and joining a second end of the tube member to a shroud that at least partially encompasses a portion of the arc body; and abutting an end of the shroud with the induction coil.

* * * * *